US006107729A

United States Patent [19]

Banno

[11] Patent Number: 6,107,729

[45] Date of Patent: Aug. 22, 2000

[54] NARROW NECK CRT WITH SLOT TYPE SHADOW MASK

[75] Inventor: Tsutomu Banno, Shiga, Japan

[73] Assignee: NEC Corporation, Tokyo, Japan

[21] Appl. No.: 09/052,153

[22] Filed: Mar. 31, 1998

[30] Foreign Application Priority Data

Mar. 31, 1997 [JP] Japan ..... 9-078737

[51] Int. Cl.[7] ..... H01J 29/07

[52] U.S. Cl. ..... 313/403; 313/477 HC

[58] Field of Search ..... 313/477 HC, 318.05, 313/402, 403, 408, 477 R

[56] References Cited

U.S. PATENT DOCUMENTS

| | | | |
|---|---|---|---|
| 4,996,458 | 2/1991 | Hottori et al. | 313/402 |
| 5,818,155 | 10/1998 | Kawamura et al. | 313/318.05 |
| 5,898,264 | 4/1999 | Nose et al. | 313/477 HC |

FOREIGN PATENT DOCUMENTS

| | | | |
|---|---|---|---|
| 8-14856 | 1/1996 | Japan | H01J 29/07 |
| 8-287841 | 1/1996 | Japan | H01J 29/07 |

OTHER PUBLICATIONS

N. Aibara et al., *High Legible Color Display Tube*, IEICE Trans. Electron, vol. E80–C, No. 8 pp. 1075–1078, Aug. 1997.

K. Hirabayashi, *High–Resolution Color Display Tube*, National Technical Report, vol. 2 pp. 251–263, Apr. 1979.

Translation K. Hirobayash, *High–Resolution Color Display Tube* National Technical Report, vol. 2 pp. 251–263, Apr. 1979.

*Primary Examiner*—Michael H. Day
*Attorney, Agent, or Firm*—Sughrue, Mion, Zinn, Macpeak & Seas, PLLC

[57] ABSTRACT

In a color cathode ray tube, a slot type shadow mask in which the vertical pitch of slots is within 0.2 mm to 0.3 mm, the width of each bridging portion is within 0.02 mm to 0.08 mm and the width of each connecting portion of the bridging portions is within 0.005 mm to 0.03 mm is combined with a neck tube of the diameter within 20 mm to 25 mm.

4 Claims, 4 Drawing Sheets

NARROW NECK CRT WITH SLOT TYPE SHADOW MASK

BACKGROUND OF THE INVENTION

1. Field of the Invention

The present invention relates to a color cathode ray tube, and more particularly to a color cathode ray tube of a shadow mask type capable of a high resolution display for use in, for instance, a terminal display device in a computer system.

2. Description of the Prior Art

FIG. 1 shows a prior art color cathode ray tube of a shadow mask type for television. A fluorescent surface 3 is deposited and formed on the inside surface of a panel 1 on which an image is displayed. The fluorescent surface 3 includes a large number of fluorescent stripes of three colors each of which continuously extends in the vertical direction relative to scanning lines of electron beams discharged from electron guns 2. A nearly cone-shaped funnel portion 5 having a tubular neck portion 4 is connected to the panel 1 to form a vacuum vessel. A unit of three electron guns 2 disposed in line is mounted in the neck portion 4. A deviation yoke 6 for making electron beams deviate is mounted on the circumference of the funnel portion 5. A shadow mask assembly 11 comprising a shadow mask 8 and a frame 10 is mounted inside of the panel 1. The shadow mask 8 is provided with slots 7 for allowing an electron beam selectively to permeate correspondingly to the fluorescent surface 3. An inside magnetic shield 12 extending toward the electron guns 2 along the inside surface of the funnel portion 5 is directly or indirectly fixed to the frame 10 of the shadow mask structure 11.

In the shadow mask type color cathode ray tube having the above construction, three electron beams discharged from the electron guns 2 are made to deviate with horizontal and vertical magnetic fields generated by the deviation yoke 6 so as to scan the entire of the fluorescent surface 3, as shown in FIGS. 1 and 2. The electron beams run into the fluorescent stripes of the corresponding colors through the corresponding slots 7 of the shadow mask 8, respectively. The fluorescent matters in the stripes are then excited and radiate to display a color image.

Generally in the slot type shadow mask 8, a large number of nearly parallel slot rows in each of which rectangular slots 7 are disposed in the vertical direction of the imaging surface at a constant vertical pitch, for instance, Pv=0.5 mm to 1.0 mm, is arranged in a regular manner at a horizontal pitch, for instance, Ph=0.5 mm to 1.2 mm, as shown in FIG. 3. A bridging portion 9 is formed between each vertically neighboring two slots 7 for maintaining the mechanical strength of the shadow mask 8. The vertical sizes of the openings of the slots 7 are nearly equal to each other. The slot rows are designed so that each bridging portion of each slot row is positioned at the vertical center of the nearest slots of both neighboring slot rows.

On the other hand, in a shadow mask type color cathode ray tube for a high resolution display, according to an in-line electron guns 2, a circular hole type shadow mask 18 in which the pitch P of the shadow mask is almost 0.2 mm to 0.3 mm and the size of each circular opening 17 is almost 0.08 mm to 0.14 mm is mostly used in combination with a dot type fluorescent surface 13, as shown in FIGS. 4 and 5.

The combination of a slot type shadow mask 8 and a stripe type fluorescent surface 3 has an advantage that a bright picture is obtained because a large aperture rate of the shadow mask can generally be obtained in comparison with the combination of a circular hole type shadow mask 18 and a dot type fluorescent surface 13. Thus, the former combination is mainly used for television as described above. When the pitch is decreased, however, a difficulty in press molding of the shadow mask due to an anisotropy of the shadow mask pattern, a difficulty in manufacturing a color cathode ray tube due to a lack of the mechanical strength of the shadow mask, or the like become remarkable. For these reasons, the former combination has scarcely been used for a high resolution display indispensable to a fine pitch. In contrast to this, the combination of a circular hole type shadow mask 18 and a dot type fluorescent surface 13 has no remarkable problem in manufacturing even in the case of a fine pitch because of the isotropy of the shadow mask pattern. This combination has thus exclusively been used for high resolution display.

On the other hand, saving power in a color cathode ray tube is recently required for saving power consumption in a color display device. For instance, saving power in a color cathode ray tube is required for the Energy Star Programme promoted by the United States Environment Protect Department, or for avoiding regulations of measures for high mode waves such as electromagnetic waves mainly promoted in Europe, especially in Sweden.

Although some measures for saving power of a color cathode ray tube can be called to mind, it is most effective among them to decrease the power for deviation. Since it is considered that the deviation power is theoretically almost in proportion to the square of the neck diameter, the deviation power is decreased by about 40% if the neck diameter is changed from conventionally 29.1 mm to 22.5 mm. Even when the neck diameter is changed to 24.3 mm, it is expected to decrease the deviation power by about 30%. For this reason, the measure that the neck diameter is decreased to decrease the deviation power is generally taken.

As for the standard neck diameter, in color cathode ray tubes for high resolution display, the neck diameter of 29.1 mm is currently used as a standard. In contrast to this, a small neck diameter of 24.3 mm or 22.5 mm begins to be used as a practical standard for the purpose of saving the deviation power.

When the neck diameter of a cathode ray tube is decreased, because electron guns sealed in the neck portion become small-sized, the degradation of focusing with decreasing the aperture size of an electron lens comes into the first question. When the largest size of electron guns within the limited space in the neck tube are designed for improving focusing, the convergence drift with orbital changes of both side beams due to charges in the inside wall of the neck portion comes into a new question. Even if the problems of focussing and the convergence drift are resolved, because the landing shift of an electron beam due to the terrestrial magnetism with the increase of the distance (Q value) between a fluorescent surface and a shadow mask corresponding to the decrease of the caliber (S value) of electron guns, the deterioration of the margin of the color purity comes into a new question.

More detailedly, we tried to develop a saving power tube in which the neck diameter is decreased to 22.5 mm in a color cathode ray tube of a circular hole type shadow mask type for a high resolution display. Although focussing and the convergence drift could meet standard levels, respectively, the problem of the color purity margin was left. That is, when the neck diameter is decreased, the caliber of an sealed electron gun is also decreased. As a result, the distance (S value) between each neighboring electron beams of three electron guns is decreased. When the S value is decreased, the Q value which is the distance between the fluorescent surface and the shadow mask must be increased more than the conventional value for densely disposing on the fluorescent surface three electron beams of blue, green and red passed through openings of the shadow mask. As a result, the movements of electron beams due to the terrestrial magnetism was also increased and the color purity margin was decreased.

Although changes in design of the shape of the inside magnetic shield in a color cathode ray tube of a circular hole type shadow mask type were considered for decreasing the landing shift of an electron beam due to the terrestrial magnetism which was increased as the result of decreasing the S value of electron guns and increasing the distance between the fluorescent surface and the mask, there was a limit in decreasing the absolute value of the landing shift of an electron beam due to the terrestrial magnetism so a sufficient decrease was not attained. As a result, although the performances in focusing and the convergence drift as those of a conventional tube could be obtained, there was left a problem that the color purity margin did not always reached to that of the conventional tube. This is shown more concretely by numerical values as the following table 1.

TABLE 1

| | comparison of properties due to differences of neck diameter, Q value and electron guns | | | | | |
|---|---|---|---|---|---|---|
| pitch and type of shadow mask | neck diameter | Q value | electron guns effective S value | landing shift by terrestrial magnetism | Cg drift | remarks |
| 0.27 mm pitch | 29.1 mm | 8.5 mm | 5.08 mm | 0.035 mm | 0.05 mm | OK |
| circular | 22.5 | 9.6 | 4.50 | 0.040 | 0.10 | NG |
| hole type | 22.5 | 10.4 | 4.10 | 0.043 | 0.05 | NG |

The landing shift by the terrestrial magnetism is represented by a changing amount of the landing position of an electron beam on a fluorescent surface after demagnetization when the tube face of a color cathode ray tube is directed from the south to the north. In the case of a circular hole type shadow mask tube with 0.27 mm pitch, this value is preferably 0.040 mm or less so it is targeted in design. As for this landing shift by the terrestrial magnetism, a conventional tube of the neck diameter of 29.1 mm was passed because its landing shift by the terrestrial magnetism was 0.035 mm. In the case of a tube of the neck diameter of 22.5 mm and the effective S value of 4.50 mm, although its landing shift by the terrestrial magnetism was 0.040 mm so it was only just passed, its convergence drift was larger as 0.1 mm so the tube was not passed as a whole. A tube of the effective S value of 4.10 mm was not passed because its landing shift by the terrestrial magnetism was 0.043 mm which exceeds the targeted value in design.

Recently, it has been found that even the combination of a slot type shadow mask and a stripe type fluorescent surface in a color cathode ray tube for a high resolution display can industrially be realized if the pitch or the like of the shadow mask is limited (the Japanese Patent Application No. 14856/1986).

In the case of this color cathode ray tube of the slot type shadow mask type, in comparison with a circular hole type shadow mask type color cathode ray tube having the equal resolution, the Q value is small as nearly half so it is hard to be affected by the terrestrial magnetism. In addition, in the case of the slot type shadow mask type color cathode ray tube, the S value of electron guns is decreased and the Q value is increased and there is a possibility substantially to decrease the landing shift by the terrestrial magnetism increased as a result of the decreased S value and the increased Q value. That is, even if it is difficult considerably to decrease the absolute value of the landing shift by the terrestrial magnetism, there is a possibility that the shape of the inside magnetic shield is changed in design so that the vertical component of the landing shift by the terrestrial magnetism is increased and the horizontal component is decreased. An increase of the landing shift of an electron beam in the vertical direction substantially never affects the color purity margin because the electron beam moves along a fluorescent stripe. A substantial affection appearing on a picture is only by the horizontal movement which is decreased so it becomes possible to prevent the color purity margin from deteriorating.

SUMMARY OF THE INVENTION

The present invention is accomplished in view of the above problems and an object of the present invention is to provide a shadow mask type color cathode ray tube with a low power consumption and without a deterioration of the color purity margin.

For attaining the above object, in a color cathode ray tube which includes a fluorescent surface provided on the inside surface of a panel of a vacuum vessel consisting of a panel portion, funnel portion and a neck portion, an electron gun structure provided in the neck portion for discharging a plurality of electron beams to excite the fluorescent surface and make it radiate, a rectangular shadow mask structure disposed near and opposite to the electron gun side of the fluorescent surface and having a large number of permeable holes for electron beams, and an inside magnetic shield directly or indirectly fixed to the shadow mask structure and extending toward the electron gun structure along the inside surface of the funnel portion, the diameter of the neck portion is within 20 mm to 25 mm, the shadow mask included in the shadow mask structure is a slot type, the vertical pitch of the slots in the shadow mask is within 0.2 mm to 0.3 mm, the horizontal pitch of the slots is within 0.2 mm to 0.3 mm, the vertical length of the bridging portion between each vertically neighboring slots is within 0.02 mm to 0.08 mm, and the vertical length of the non-etched flat portion of each bridging portion corresponding to the surface or back surface of the shadow mask is within 0.005 mm to 0.03 mm. By this construction, the problem with narrowing the neck in a color cathode ray tube of a circular hole type shadow mask type for a high resolution display can be avoided.

DETAILED DESCRIPTION OF THE PREFERRED EMBODIMENTS

Figure 1:
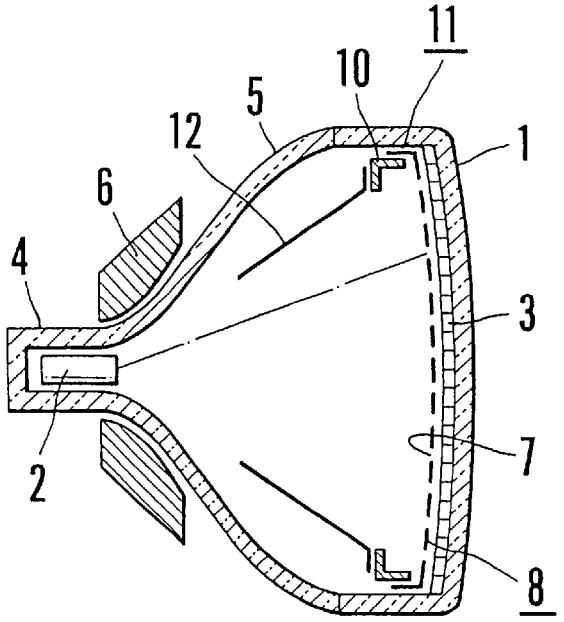
FIG. 1 PRIOR ART
FIG. 1 is a cross-sectional view showing the construction of a prior art color cathode ray tube.
Figure 2:
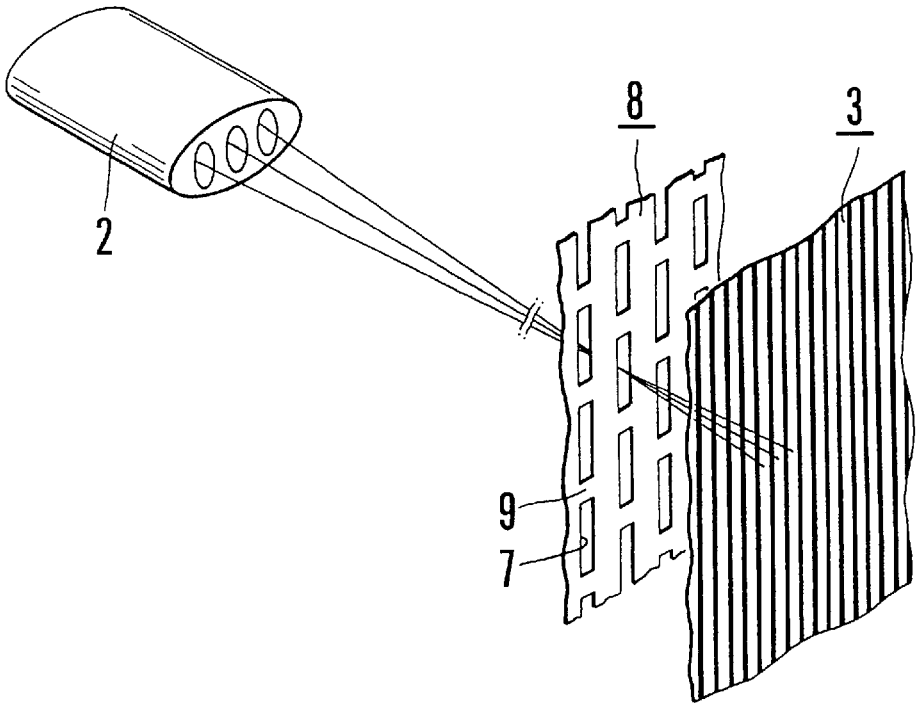
FIG. 2 PRIOR ART
FIG. 2 is a sketch for illustrating the combination of in-line type electron guns, a slot type shadow mask and a stripe type fluorescent surface.
Figure 3:
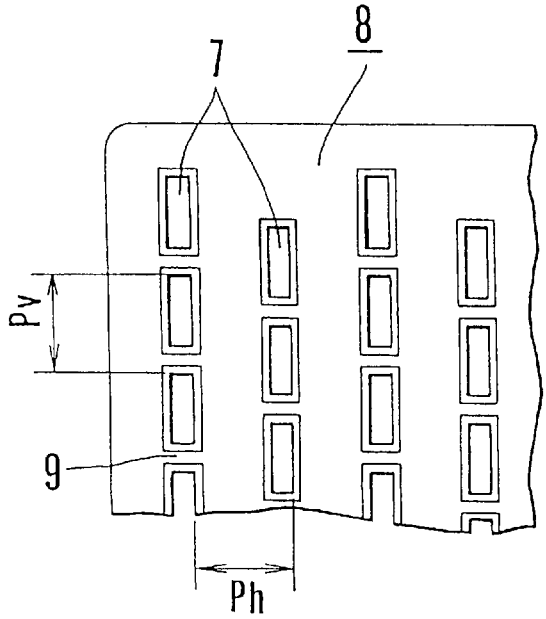
FIG. 3 PRIOR ART
FIG. 3 is a plan view for illustrating a slot type shadow mask used in a prior art color cathode ray tube for television.
Figure 4:
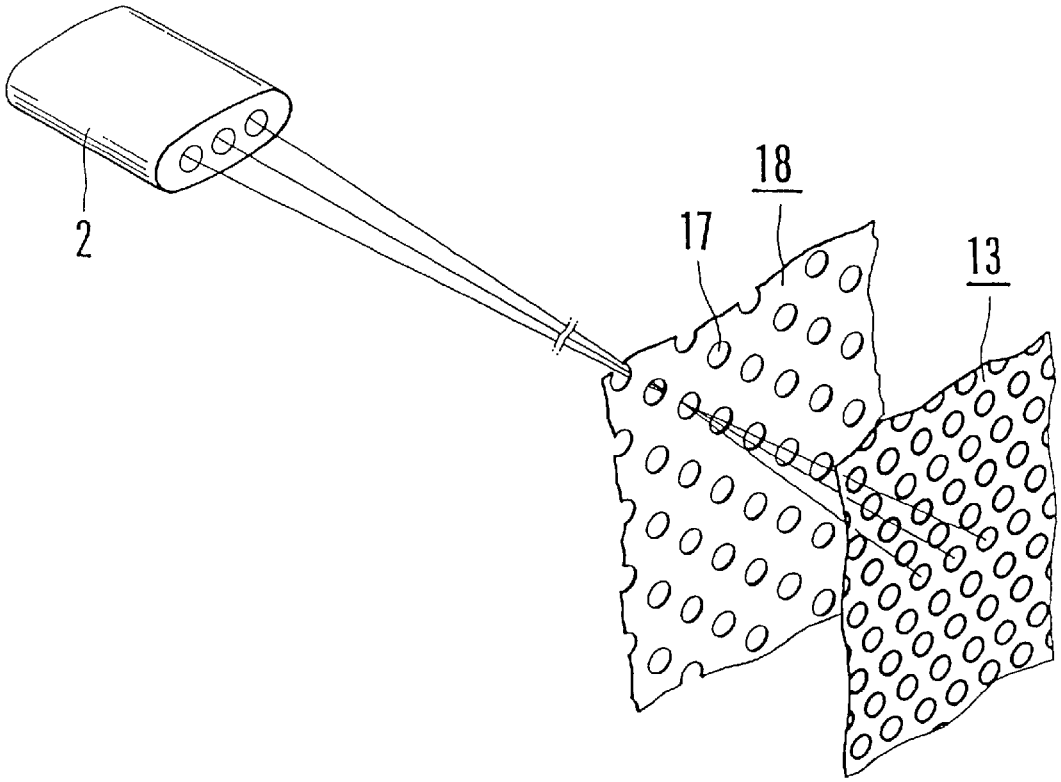
FIG. 4 PRIOR ART
FIG. 4 is a sketch for illustrating the combination of in-line type electron guns, a circular hole type shadow mask and a dot type fluorescent surface.
Figure 5:
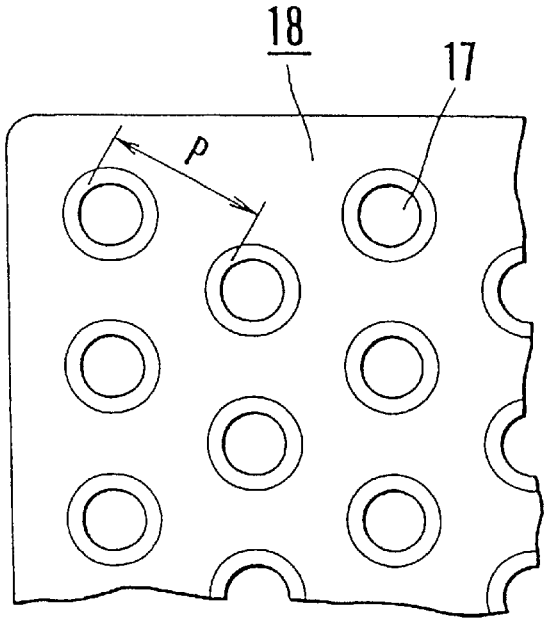
FIG. 5 is a plan view for illustrating a circular hole type shadow mask used in a prior art color cathode ray tube for a high resolution display.

Hereinafter, embodiments of the present invention will be detailedly described.

Since the basic shape of a slot type shadow mask included in the present invention is equal to that of a prior art slot type shadow mask, the common part is denoted by a parallel reference in the drawings.

Figure 6:
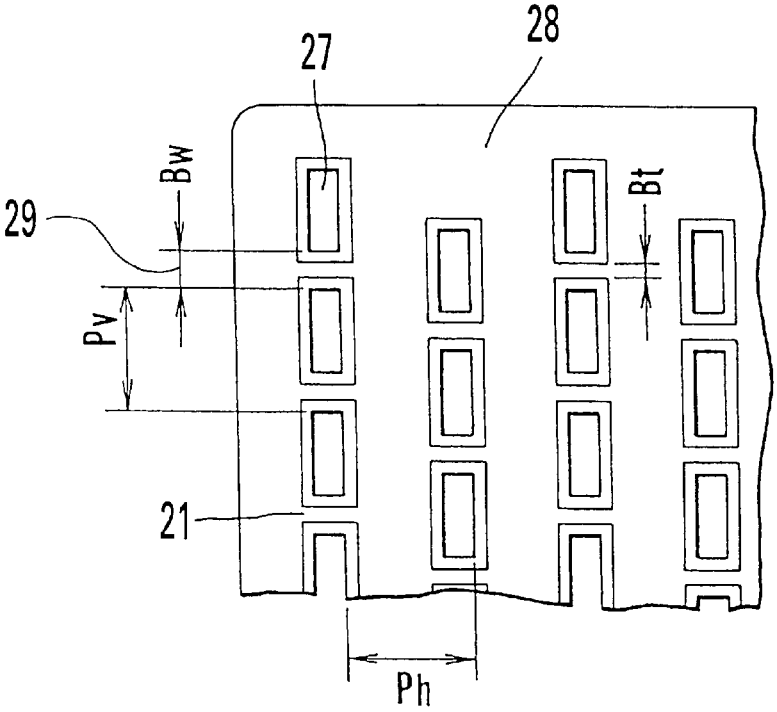
FIG. 6 is a plan view for illustrating a slot type shadow mask used in the present invention.
Figures 7A, 7B:
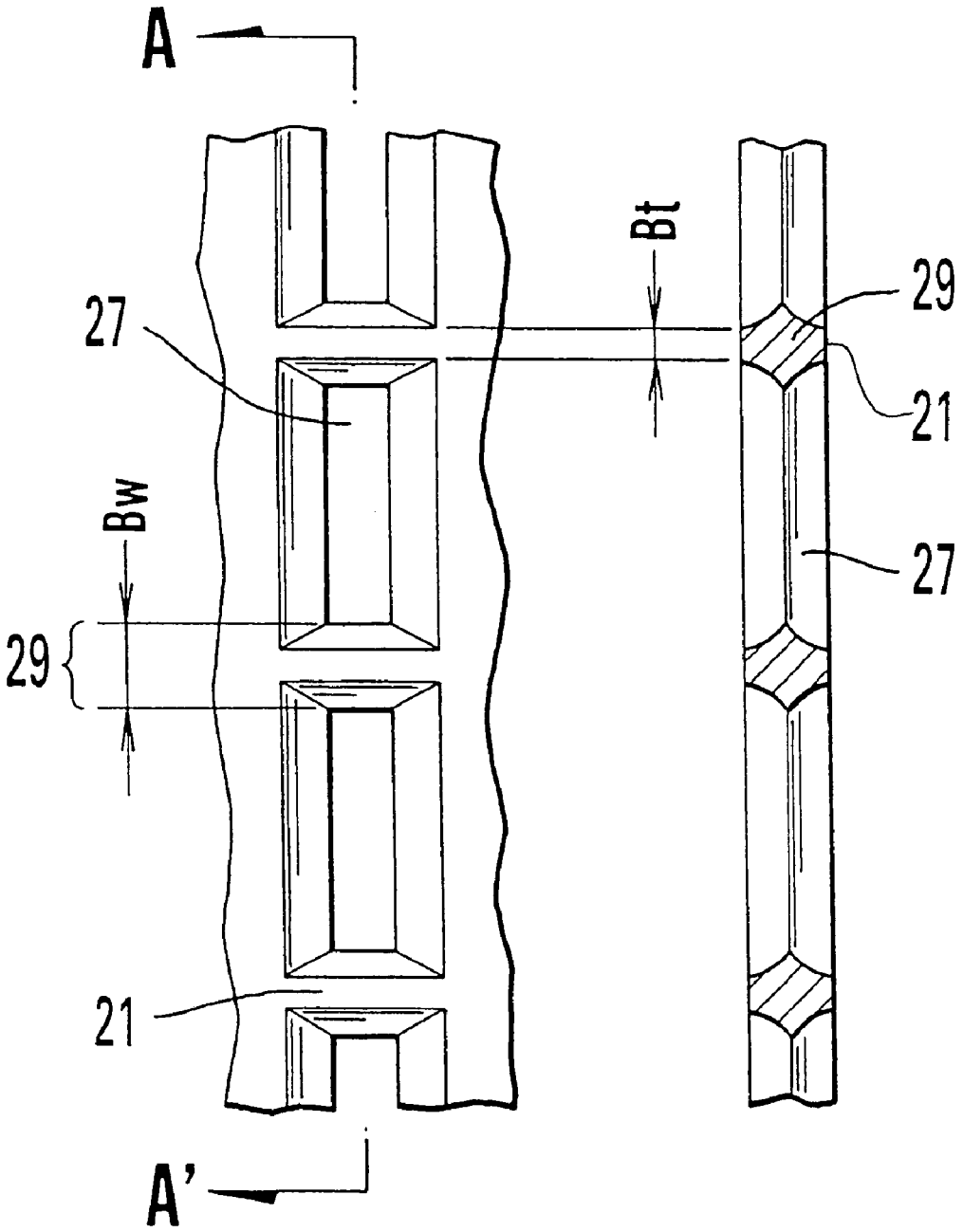
FIG. 7A is an enlarged plan view of the slot portions and the bridging portions in the slot type shadow mask used in the present invention.
FIG. 7B is a cross-sectional view of the slot portions and the bridging portions in the slot type shadow mask used in the present invention.

We experimentally produced 15 inch color cathode ray tubes for high resolution display in which narrow neck tubes of the neck diameter of 22.5 mm, slot type shadow masks 28 of a fine pitch shown in FIGS. 6, 7A and 7B and two kinds of electron guns of the effective S values of 4.50 mm and 4.10 mm were combined, and they were compared for estimation with a tube of the conventional neck diameter using a circular hole type shadow mask of the neck diameter of 29.1 mm. A reason why the neck diameter of 22.5 mm was selected was as follows. The neck diameter less than 20.0 mm is not preferable because there is a problem that the neck tube is apt to snap. The neck diameter more than 25.0 mm is also not preferable because the most important power saving effect is about 26% or less of that of a neck tube of 29.1 mm so it presents little appeal to users. A neck tube of 22.5 mm which has mostly been used in a color cathode ray tube for television was thus considered an appropriate choice because its power saving effect is considerable as 40%.

For the electron guns for the narrow neck, a type the effective S value of which was estimated at 4.50 mm and a type the effective S value of which was estimated at 4.10 mm were used. In the conventional neck diameter, the effective S value of electron guns was estimated at 5.08 mm. Here, the reason why the term "estimate" is used is that the S value of electron beams is determined from the result of a computer simulation because it is difficult actually to measure it.

For the shadow mask 28, a slot type 27 in which the horizontal pitch Ph shown in FIGS. 6, 7A and 7B was 0.25 mm and the vertical pitch Pv was 0.235 mm and which had the resolution nearly equal to that of a circular hole type of the pitch of 0.27 mm was used. The horizontal pitch Ph less than 0.2 mm is not preferable because the possibilities to generate a problem in the strength of the shadow mask structure and a problem in color purity are increased. The horizontal pitch Ph more than 0.3 mm is also not preferable because the resolution is difficult in the case of fine displayed letter characters. The vertical pitch Pv more than 0.3 mm is not preferable because of problems that the field of a displayed picture feels rough and letter characters are hard to read due to an intervention between displayed letter characters and shadows of the bridging portions. The vertical pitch Pv less than 0.2 mm is also not preferable because a sufficient brightness can not be obtained.

In this slot type shadow mask 28 used, the vertical length Bw of each bridging portion 29 was within 0.02 mm to 0.08 mm and the vertical length Bt of the non-etched flat portion 21 of each bridging portion was within 0.005 mm to 0.03 mm. If the vertical length Bw of each bridging portion is less than 0.02 mm or the vertical length Bt of the non-etched flat portion 21 of each bridging portion is less than 0.005 mm, a bridging portion is locally stretched and snapped at molding the shadow mask so it is not fit for use. If the vertical length Bw of each bridging portion 29 is more than 0.08 mm or the vertical length Bt of the non-etched flat portion 21 of each bridging portion is more than 0.03 mm, the rate of utilizing electron beams is inferior to that of a circular hole type shadow mask type tube so it is undesirable for a product.

The inside magnetic shield 12 was most suitably designed so that the horizontal component of the landing shift by the terrestrial magnetism is minimized for a slot type shadow mask type tube.

The result of an estimation of the experimental products including the neck tube of 29.1 mm is shown in the following table 2.

TABLE 2 comparison of properties due to differences of neck diameter, Q value and electron guns

| types of shadow mask | neck diameter | Q value | electron guns effective S value | transfer amount by terrestrial magnetism | Cg drift | remarks |
|---|---|---|---|---|---|---|
| circular hole type | 29.1 mm | 8.5 mm | 5.08 mm | 0.035 mm | 0.05 mm | OK |
| slot type | 22.5 | 5.0 | 4.50 | 0.007 | 0.10 | NG |
| | 22.5 | 5.5 | 4.10 | 0.007 | 0.05 | OK |

The landing shift by the terrestrial magnetism is represented by a changing amount of the landing position of an electron beam on a fluorescent surface after demagnetization when the tube face of a color cathode ray tube is directed from the south to the north. In slot types, only the values of the horizontal components are shown. In the case of a slot type shadow mask tube with 0.25 mm pitch, this value is preferably 0.010 mm or less so it is targeted in design. Even the neck diameter of 22.5 mm cleared it.

The convergence drift (Cg) less than 0.10 mm is indispensable so electron guns of the effective S value of 4.50 mm can not be used.

As described above, in the case of a color cathode ray tube in which a slot type shadow mask and a stripe type fluorescent surface are combined with a narrow neck of 22.5 mm, in comparison with a color cathode ray tube having a dot type fluorescent surface including a circular hole type shadow mask having the equivalent resolution shown in the table 1, the change of the position of an electron beam on the fluorescent surface due to the terrestrial magnetism could substantially considerably be decreased and the targeted value in design for a slot type shadow mask type color cathode ray tube could be cleared and the problem of the color purity margin could be resolved.

That is, when the resolutions are nearly equal, since the distance (Q value) between the fluorescent surface and shadow mask of a slot type is decreased to almost half of that of a dot type, the absolute value of the landing shift by the terrestrial magnetism becomes almost half even when considering geometrically. Furthermore, in the case of a stripe type fluorescent surface, by designing a shape of the inside magnetic shield to control the moving direction of an electron beam due to the terrestrial magnetism so as to move more greatly in the vertical direction than in the horizontal direction, the landing shift of the electron beam on the fluorescent surface due to the terrestrial magnetism could substantially considerably be decreased (one fifth or less) in comparison with a dot type as a result. That is, narrowing neck which was difficult in a color cathode ray tube for high resolution display could be realized at a product level with margins in properties by combining with a slot type shadow mask.

As described above, by a combination of a narrow neck and a slot type shadow mask, in comparison with a conventional combination with a circular hole type shadow mask, a small Q value almost half in structure could be obtained, and by designing a shape of an inside magnetic shield, the moving direction of an electron beam due to the terrestrial magnetism could be controlled so as to increase in the vertical direction and decrease in the horizontal direction so the deterioration of the color purity margin due to the affection of the terrestrial magnetism could be decreased. Furthermore, by a combination with a stripe picture by employing a slot type shadow mask, in comparison with a dot picture, an effect that edges of letter characters or images are sharply visible was obtained and power saving could be attained with keeping the display performance as conventional or more.

What is claimed is:

1. A color cathode ray tube comprising:

a fluorescent surface provided on the inside surface of a panel of a vacuum vessel which has a panel portion, funnel portion and a neck portion;

an electron gun structure provided in the neck portion for discharging a plurality of electron beams to excite the fluorescent surface and make it radiate;

a shadow mask structure of a slot type disposed near and opposite to the electron gun side of the fluorescent surface and having a large number of permeable holes for electron beams; and an inside magnetic shield directly or indirectly fixed to the shadow mask structure and extending toward the electron gun structure along the inside surface of the funnel portion, wherein the diameter of said neck portion is within 20 mm to 25 mm, the vertical pitch of the slots in said shadow mask is within 0.2 mm to 0.3 mm, the horizontal pitch of said slots is within 0.2 mm to 0.3 mm, the vertical length of the bridging portion between each vertically neighboring slots is within 0.02 mm to 0.08 mm, and the vertical length of the non-etched flat portion of each bridging portion corresponding to the surface or back surface of said shadow mask is within 0.005 mm to 0.03 mm;

wherein said fluorescent surface and said shadow mask are spaced by a distance such that, and said electron gun has an effective S value such that, said color cathode tube has a convergence drift of less than 0.1 mm.

2. The color cathode ray tube according to claim 1, wherein said distance is 5.5 mm.

3. The color cathode ray tube according to claim 1, wherein said effective S value is 4.1 mm.

4. The color cathode ray tube according to claim 1, wherein a transfer amount by terrestrial magnetism is less than 0.035 mm.

* * * * *